United States Patent [19]

Lessi et al.

[11] Patent Number: 4,940,094

[45] Date of Patent: Jul. 10, 1990

[54] METHOD AND DEVICE TO ACTUATE SPECIALIZED INTERVENTION EQUIPMENT IN A DRILLED WELL HAVING AT LEAST ONE SECTION HIGHLY SLANTED WITH RESPECT TO A VERTICAL LINE

[75] Inventors: Jacques Lessi, Maule; Michel Tholance, Feucherolles, both of France

[73] Assignee: Institut Francais du Petrole, Rueil-Malmaison, France

[21] Appl. No.: 234,076

[22] Filed: Aug. 19, 1988

[30] Foreign Application Priority Data

Aug. 19, 1987 [FR] France ..... 87 11749

[51] Int. Cl.[5] ..... E21B 34/14

[52] U.S. Cl. ..... 166/373; 166/154; 166/332; 166/386

[58] Field of Search ..... 166/373, 381, 385, 386, 166/117, 166, 318, 332, 317, 154, 155, 156, 153

[56] References Cited

U.S. PATENT DOCUMENTS

| | | | |
|---|---|---|---|
| 2,999,545 | 9/1961 | Bigelow | 166/318 |
| 3,263,752 | 8/1966 | Conrad | 166/318 |
| 3,811,500 | 5/1974 | Morrisett et al. | 166/153 |
| 4,349,072 | 9/1982 | Escaron et al. | 166/55 |
| 4,457,370 | 7/1984 | Wittrisch | 166/250 |
| 4,484,628 | 11/1984 | Lanmon, II | 166/250 |
| 4,729,429 | 3/1988 | Wittrisch | 166/385 |

*Primary Examiner*—Jerome W. Massie, IV
*Assistant Examiner*—TerryLee Melius
*Attorney, Agent, or Firm*—Antonelli, Terry, Stout & Kraus

[57] ABSTRACT

A method and device for actuating specialized equipment in a drilled well having at least one well zone, sharply slanted with respect to the vertical, and with the drilled well having at least one tubular control column along which operating eqipment as remotely installed. A control member is introduced in to the first tubular control column, with a cable being attached at one end of the control member. The control member is lowered into the first tubular control column by a downward hydraulic pumping, and the cable is paid into the tubular pipe from the surface. The control member is raised by pulling on the cable from the surface and the specialized operating equipment is selectively maneuvered while the control member is flush against the equipment in a downward or upward travel of the control member in the drilled well.

15 Claims, 3 Drawing Sheets

METHOD AND DEVICE TO ACTUATE SPECIALIZED INTERVENTION EQUIPMENT IN A DRILLED WELL HAVING AT LEAST ONE SECTION HIGHLY SLANTED WITH RESPECT TO A VERTICAL LINE

BACKGROUND OF THE INVENTION

The present invention relates to a method and device for actuating specialized manipulating equipment in a drilled well which has at least one section sharply slanted with respect to a vertical or even a horizontal line.

It is known that specialized equipment such as, in particular, valves located in a well can be operated by lowering, by gravity, control members which, at the level of the members, trigger their operation. However, such members cannot be used to start devices located in sharply slanted well sections, and remain in the well after starting.

It is known that some of these control members can be recovered from the well by using the wire line cable operating technique, but this technique does not apply to sharply slanted wells.

It is known that devices can be controlled by pumping in a first direction, from the surface, a control member designed to cooperate with these devices in order to start them up, then reverse the pumping direction to bring the member back to the surface. However, such members, which can be used in sharply slanted or even horizontal wells, require pumping to be accomplished in two opposite directions.

Such techniques are described in particular in U.S. Pat. Nos. 4,349,072, 3,656,562, 3,263,752, 2,752,855, and 2,999,545.

The object of the present invention is to furnish an assembly and an operating method which do not have the aforementioned drawbacks and which, in particular, make it possible selectively to control a large number of specialized operating equipment items such as valves, placing them in communication with a pipe from ground-level parts substantially separated hydraulically, at least to the level of the well.

Hence, the object of the present invention is to provide a method for actuating specialized equipment in a drilled well having at least one zone sharply slanted with respect to the vertical, with the drilled well having at least one first tubular pipe along which the equipment is remotely installed, wherein a control member is inserted into the first tubular pipe, and a cable is attached to one end of the member. The control member is lowered into the tubular pipe by downward hydraulic pumping, and the cable is paid into the tubular pipe from the surface. The control member is raised by pulling on the cable from the surface, and the specialized equipment is slectively actuated when the control member passes flush with the equipment as it is being lowered or raised. Advantageously, according to the present invention, at the surface of the ground, the control member is equipped at its circumference with at least one key sliding bolt. The key sliding bolt is adapted to cooperate with a control seat of one of the specialized equipment items whose shape matches the sliding bolt. The control member is moved into the first pipe so that it comes up flush against a selected equipment item. The key sliding bolt is interlocked with the seat associated with the equipment, and movement of the member actuating the equipment is prolonged. Once the maneuver has been carried out, the key sliding bolt is disengaged from the seat, and the control member is raised to the surface.

In one particular embodiment of the invention, wherein the first pipe is a tubular control column and the specialized equipment items are valves for producing fluid from geological formations traversed by the well, the valves are controlled by the control member, and fluid flows into the control column, with the fluid being brought to the surface in a second pipe constituting a production column connected at a lower end thereof, with a lower end of the tubular column.

The present invention also applies to a device for actuating specialized equipment in a drilled well having at least one zone sharply slanted with respect to the vertical, with the drilled well having at least one first tubular pipe along which said equipment is remotely installed. A control member is introduced into the first tubular pipe and is connected to the surface by a cable at one of its ends. A hydraulic downward pumping means moves the member into the tubular pipe, and means are provided for paying the cable into the tubular pipe. Pulling means pull on the cable from the surface, and means are provided for selectively controlling the specialized equipment when the control member passes flush with the equipment when lowered or raised.

Advantageously, the control member has at its circumference at least one key sliding bolt able to cooperate with a control seat of a specialized equipment item which matches the key sliding bolt in shape.

In one particular embodiment, the device also has means for interlocking the key sliding bolt with the associated seat, means for driving the equipment by the member when interlocking takes place, and means for disengaging the key sliding bolt when the maneuver has been carried out.

According to one preferred embodiment, wherein the first pipe is a tubular control column and the specialized equipment items are valves producing fluid from geological formations traversed by the well, the device also has a second pipe constituting a production column connected at its lower end with the lower end of the tubular control column.

Advantageously, the device has a pump located in the production column.

The present invention also relates to a system for producing fluid from a geological formation traversed by a drilled well having a device for actuating equipment such as that already described, characterized by the well being divided into several separate production zones isolated from each other by sealing means of the packer type, with at least one valve being disposed in a production zone.

BRIEF DESCRIPTION OF THE DRAWINGS

The invention will be readily understood and all its advantages will emerge clearly from reading the following description of one example illustrated in the attached figures, wherein.

DETAILED DESCRIPTION

Figure 1:
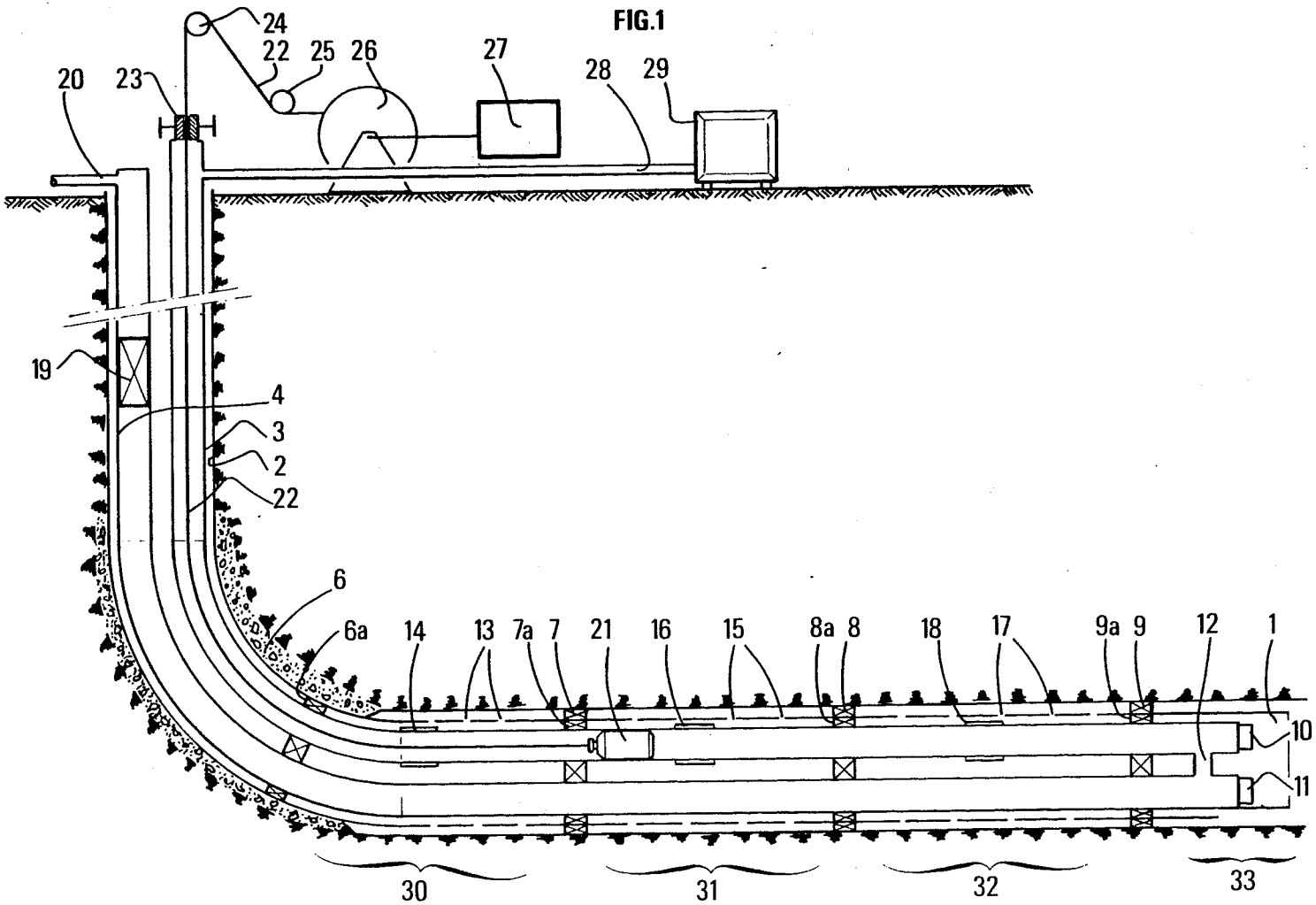
FIG. 1 is a sectional view of an equipped well according to the present invention.

FIG. 1 shows a well 1 having at its lower part a section highly slanted to the vertical, ending in a horizontal section. The well 1 has on its internal wall a casing 2 made in the form of tubular elements, attached by cementing joints 6, with which elements the inner wall of the borehole is lined to support the wall. Well 1, which passes through geological formations from which fluid is to be produced, has various production zones 30, 31, 32, and 33, with each production zone 30, 31, 32 communicating with zones inside the casing 2 through openings 13, 15, and 17, respectively. The production zones are separated from each other by annular seals 7, 8, and 9 of the packer type. Thus, the fluid located in the formation isolated laterally between two seals is directed into the casing 2 by openings 13, 15, and 17.

After the fluid from the formation has been introduced into the casing 2 through the openings, it is necessary to bring the fluid up to the surface. For this purpose, a pipe such as a production column 4 is disposed in the casing 2.

In order to be able to select the production zone where the fluid is to be collected and bring the fluid to the surface, the casing 2 is equipped with another pipe constituting a tubular control column 3.

Inside the casing 2, the production column 4 and the tubular control column 3 are kept parallel to each other by double packers 6*a*, 7*a*, 8*a*, 9*a* also constituting sealing means between the casing 2 and the columns 3 and 4 so that, inside the casing 2, the fluid introduced through openings 13, 15, and 17 forms a volume delimited by two sections corresponding to packers at different levels.

In a preferred embodiment, the packers 7*a*, 8, and 9*a* inside the casing 2 are at the same level in the well 1 as the seals 7, 8, and 9, whereby the volumes delimited in the casing coincide with production zones 30, 31, and 32.

Production column 3 4 is connected to the tubular control column 3 by a linking element 12 such as a tube located at the bottom end of the two pipes. This production column 4 has, at the proper height, a circulating pump 19 which draws up and the fluid from the formation and drives the drawn fluid to the surface to the ground through an orifice 20. The position of pump 19 in the well 1 may be substantially below the dynamic level of a producing formation. According to the invention, the circulating direction of the fluid through the pump 19 may be upward and one-way.

The production zone chosen for working is made to communicate via the casing openings 13, 15, 17 with the volume of fluid around the two columns 3 and 4 delimited by two successive packers.

This fluid volume flows into tubular control column 3 through circulating valves 14, 16, and 18 such as sliding-jacket valves.

In production, the valves 14, 16, and 18 are normally provided with check valves preventing fluid from circulating in the pipe back into the formations, but these check valves may very well be eliminated when, for example, it is desired to fracture a zone.

The lower end of tubular control column 3 has a valve 10 and the lower end of production column 4 has a valve 11, each remote-controllable, such as sliding-jacket valves similar to valves 14, 16, 18. By equipping each end of pipes 3, 4 with a valve enables the lower part 33 of the well to be placed in communication so as to produce fluids at the bottom of the well 1 and allows the ends to be available for specific well operating requirements such as lowering a tool through the valve to scrape the well 1.

The opening and closing of the valves 10, 14, 16, and 18 are selectively controlled from the surface of the ground by a member 21 lowered by hydraulic pumping produced by a pumping station 29 connected to tubular control column 3 by a system of pipes 28. When being lowered, the control member 21 is connected to a cable 22 passing through a stuffing box 23 so that the member 21 is lowered by a technique similar to that of pumped tools currently known as the TFL (through flow line) technique.

After passing through the stuffing box 23, the cable 22 is taken up by two return pulleys which direct the cable 22 to a winch 26 controlled by a station 27.

In the case of a sharply slanted well, the force of gravity is not sufficient to lower control member 21 to the end of the well 1. Thus, for lowering tubular control column 3, hydraulic pumping of a fluid such as degassed oil is used, and the cable 22, pulled by winch 26, is used for lifting.

Member 21, when moved by pumping and by the cable 22, rapidly controls opening and closing of circulating valves 10, 14, 16, and 18 without requiring any major operation such as movement of the pump 19.

In the foregoing, the description has been developed in the case of valve opening and closing, but the invention remains advantageous when other specialized operating tools that need to move from the active to the passive state and vice versa have to be controlled.

Control member 21 is operated as follows:

Control member 21, connected at one end to cable 22 is introduced through the surface opening of the tubular control column 3. A stuffing box 23 is then placed around the cable 22 at the upper end of the tubular control column 3.

Since the upper end of the control column 3 is connected to the pumping station 29 by the system of pipes 28, the pumping liquid is injected so as to move control member 21 into its operating position with the cable 22 being paid out as the control member 21 advances.

In the embodiment shown in FIG. 1, it is desired to the zones 30, 31, 32, and 33 produce in succession. To accomplish these production stages, the valve 14 is made to open and the valves 16, 17, and 10, to close. The fluid from the zone 30 flows through the casing 2 via the openings 13 and fills the volume between the packers 6A and 7A. When the valve 14 is opened by the control member 21 (by means explained hereinbelow) fluid is introduced into the tubular column 4, falls to the end, and is pumped up to the surface by the pump 19. When the zone 30 has been fully worked member 21 closes the valve 14 and opens the next valve 16, to cause next zone 31 to produce.

Circulating valves 14, 16, 18, and 10 or any other equipment such as measuring devices, tools, or instruments are actuated by the control member 21 by prolonged downward pumping and by pulling upward on the cable 22.

When the control member 21 has completed its opening or closing maneuver, the control member 21 rises to the surface, activating the winch 22 which produces an upward pull. The control member 21 could also be placed temporarily at the bottom of the first control column 3 beyond the junction with the production pipe 4.

With a suitable control 21, it becomes possible to accomplish the maneuvers of a number of devices without having to pull up the control member 21. The devices can be actuated while the control member 21 is being lowered to the bottom of the well 1 and/or while it is being raised from the bottom of the well 1. For this purpose, the control member 21, and the device will include all the required connected key parts.

In the same way as the devices are operated by the control member 21 connected by a cable 22 to the surface, tools or instruments may be placed in the pipe by causing the control member 21 to move in either direction by pumping or by pulling on the cable 22.

Cable 22 may include electrical conductors designed to transmit information or to the control member 21, in particular to control its cooperation with the device to be operated.

FIGS. 2, 2A, 3, and 4 show control member 21 cooperating with sliding-jacket valve 16 to cause production from second production zone 31 to stop.

Control member 21 has a body 35 which allows no production fluid to pass through when no pull is exerted on the cable 22. The outer seal between the control member 21 and the inside of the tubular control column 3 is provided by a joint 36. Body 35 also has a hooking part forming a key sliding bolt 37 having a transversal groove. These key sliding bolts 37 are positioned in body 35 at notches 56 distributed circumferentially around the member. In the embodiment shown in cross section in FIG. 3, device 35 is provided with three notches, a key sliding bolt 37 being engaged in each of them.

Of course, it would be possible to place only one sliding bolt around the control member 21. This key sliding bolt, which has a special shape for opening and closing a specific valve, is installed at the surface on control member 21 and must thus be replaced for each operation.

Valve 16 itself has a body 42 integral with the control column 3 in which a tubular liner 39 slides. This liner 39 is machined so that internally it has a first seat in the shape of a rib 38 associated symmetrically with the groove of key sliding bolt 37.

Figure 2:
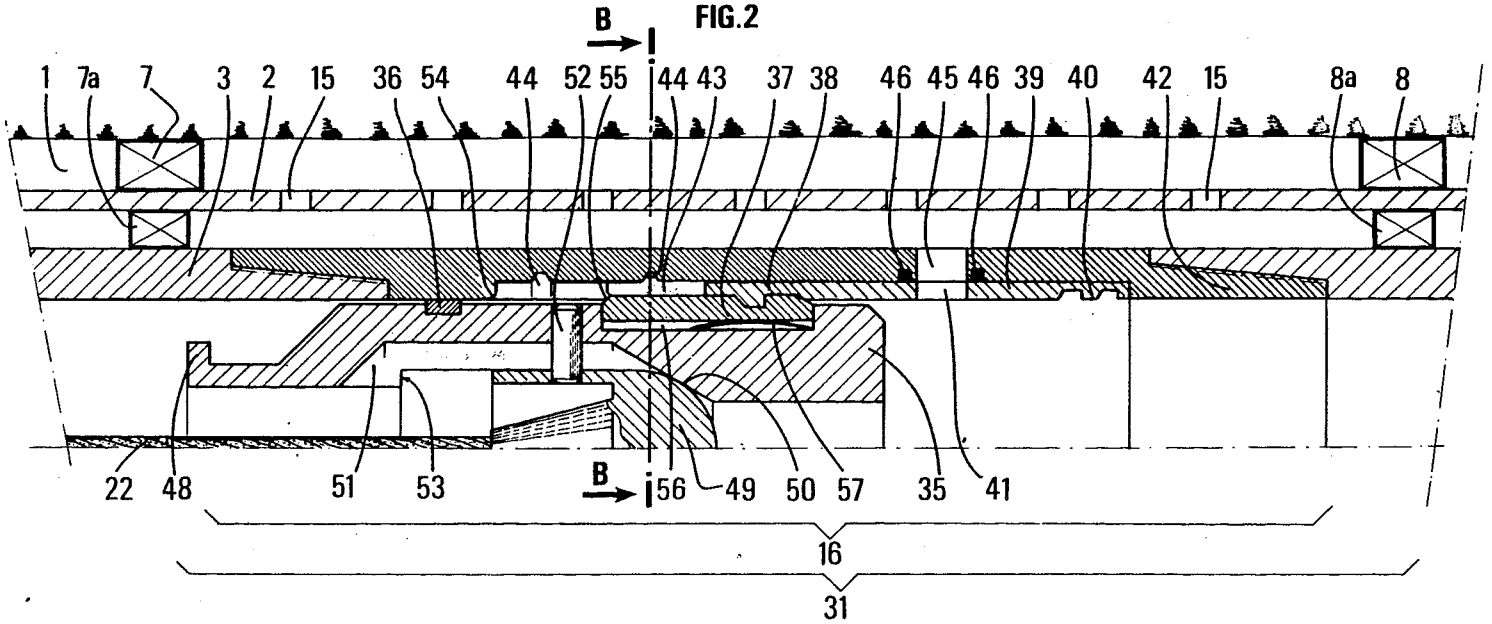
FIG. 2 shows in detail the control member according to the present invention at the level of a valve to be actuated.
Figure 2A:
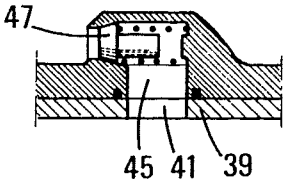
FIG. 2A shows in detail the check valves of sets of openings in the body of a valve.
Figure 3:
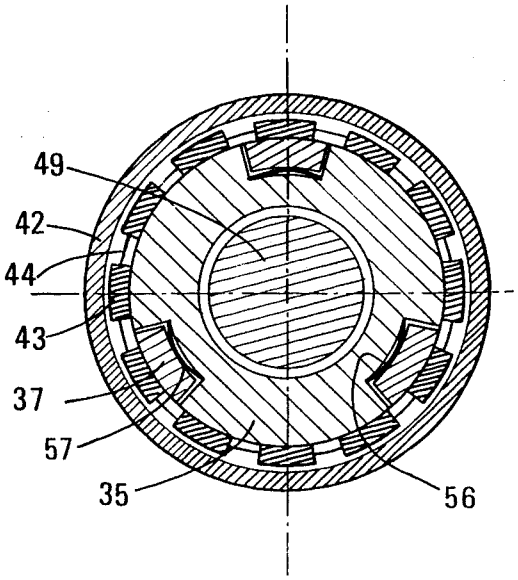
FIG. 3 is a cross-sectional view of the valve in cooperation with the control member; an FIG. 4 is an exploded view of the opening lining of the valve.
Figure 4:
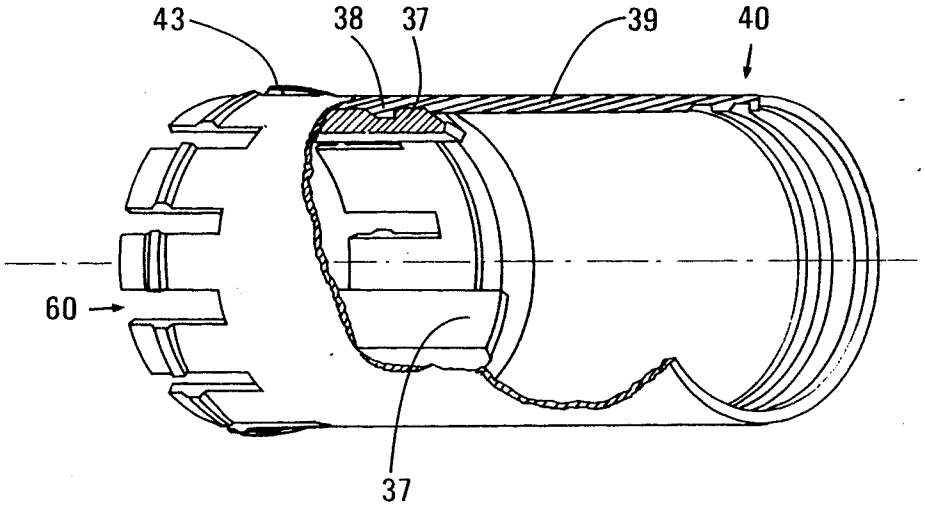

In FIG. 2, the control member 21 is equipped with a key sliding bolt 37 which cooperates with first seat 38 for closing the valve 16.

Liner 39 of the valve 16 has a second seat 40 associated with the shape of a key sliding bolt for opening the valve 16. A set of openings 41 in the liner 39 allows fluid to pass inside the tubular control column 3 depending on the position of liner 39.

However, as can be seen in FIG. 2, the key sliding bolt 37 has no effect on the seat 40 since the shapes do not match and it is therefore necessary to replace the key sliding bolt at the surface to install a shape that matches the seat 40.

In order to open or close the valve 16, the liner 39 is made to slide in relation to the body 42 between two end positions. Each end position is defined by introduction of an elastic snug 43 circumferentially around the liner 39 in a groove provided in the valve body. These two end positions are clearly visible in FIG. 2. The opening position coincides with a stop of liner 39 in front of the valve 16 (i.e. at packer 8*a*), and the closing position coincides with a stop at the rear. Elastic snug 43 is not formed entirely circumferentially. Slots 60 are provided lengthwise inside the axis of the liner 39 to enable the snugs 43 to be freed easily from the bottom of the groove because of their elasticity.

Depending on the position, a set of openings 45 located in the body 42 of the valve 16 will or will not be opposite the set of the openings 41 located in liner 39. The seal between the liner 39 and the valve body 42 is provided by joints 46. Openings 45 open into a check valve 47 (FIG. 2A) which makes it unnecessary to inject pumping fluid into the producing layers while allowing fluid to be produced from these layers.

The linkage of the cable 22 to the control member 21 comprises a low-traction point whose strength is greatly below the elastic yield point of the cable 22 but well above the shear strength of a pin 52 so as to enable the cable 22 to be removed if the control member 21 jams and allow the latter to be retrieved.

Control member 21 has a nose 48 enabling the control member 21 to be retrieved. It also has means for circulating fluid through the control member when the pull on the cable 22 exceeds a certain threshold.

These means comprise a preventer seal 49 cooperating with a seat 50 in the closed position and sliding onto guides 51 when a pin 52 holding the preventer 49 is sheared when a predetermined pull is exerted by cable 22 on the control member 21. The travel of the preventer seal 49 in the open position is limited by a stop 53. When the pin 52 is sheared, it is thus possible to raise the control member 21 by pulling on the cable 22 without having to evacuate pumping fluid from the column.

If it is desired to close the valve 16, first the control member 21 is equipped at the surface with key sliding bolts 37 associated with the closing seat of the valve corresponding to the rib 38. Then, by hydraulic pumping, the control member 21 is lowered until the key sliding bolt 37 engages the rib 38, then circulation of pumping fluid is stopped and the cable 22 is pulled so as to move the liner 39 and thus close the valve 16.

To raise the control member 21, a pull greater than the pull on the liner 39 for closing the valve 16 is exerted on the cable 22 such that the sliding bolt 37, by being moved aside in notches 56, becomes disengaged from the rib 38 and the pin 52 may be sheared, enabling the internal circulating means of the device to be activated.

The release of the key sliding bolt 37 from the seat embodying the rib 38 is effected, for example, at the end of the pull on the cable 22 by the cooperation of a chamfer 54 of the valve 16 with a beveled edge 55 of the sliding bolt 37. Sliding bolt 37 is moved aside in the notch 56 of the body 35 by the flattening of a return spring 57 located under the key sliding bolt 37. The control member 21 is then raised to ground level by a prolonged pole on the cable 22.

Now, for a reverse movement, i.e. opening the valve 16, the control member 21 is equipped at the surface with a key sliding bolt having a shape matching that of the seat 40, the control member 21 is lowered by hydraulic pumping until the key sliding bolt and seat 40 cooperate together, and pumping is continued to cause the liner 39 to advance until the valve 16 opens.

The control member 21 is raised to ground level as before by pulling on the cable 22, whereby the beveled surfaces of the key sliding bolt and the liner 39 allow the sliding bolt to be disengaged without moving the liner 39.

Once the valves 10, 14, 16, and 18 have been placed in the desired operating positions (i.e., in the case where production is beginning in zone 30: valve 14 open, valves 16, 18, 10 closed), and when tech control member 21 has been raised if necessary, the pump 19 is started so that the fluids from the formations selected can penetrate the tubular control column 3, proceeding as far as linking element 12, and flow via the production column 4, passing through pump 19, to opening 20. The tubular control column 3 could also be applied with a pump able to replace the pump 19 of the production column 4.

Pump 19 may be a centrifugal pump or a cup packed pump designed to cooperate with production column 4 for its setup and use. Replacing pump 19 by any other pumping means such as a gas lift valve would not constitute a departure from the present invention.

The details of the above description specified that the key sliding bolts be changed for each valve, but the present invention could easily be adapted to use only two key sliding bolt shapes, the first being used to open all the valves and the second to close them.

Without departing from the scope of the present invention, it would be possible to apply the method and operating assembly according to the invention to offshore wells.

Control member 21 could include articulations such that it can circulate in wells with a small radius of curvature, and the control member 21 could comprise sealing elements 36 located on either side of the sliding bolt 37 and include tools such as a back-off tool.

As in the case of the pumped tools technique, it would be possible to scrape off paraffin while simultaneously pumping solvent if necessary, to install and remove production tools (plug, check valve, safety valve, gas lift valve, instruments such as jet pumps), rinse off sand deposited in production zones, record the bottom pressure, inject treatment products, provide instrumentation on jammed rod strings, etc.

The control member 21 could also comprise an internal bypass regulator which allows fluid to pass through it from the upper part of the control member to the lower part of the control member 21. Regulation either allows circulation to continue in the first pipe when the control member 21 has jammed in the course of its travel or allows the force produced by the pressure to be distributed over several sealing elements 36.

The control member may have an extension piece allowing devices such as the valve 10 to be maneuvered beyond the hydraulic linking element 12.

The controlled devices could be measuring instruments. The gap between the casing 2 and the pipe 3, particularly that located above sealing element 6*a*, could be used to constitute the return column instead of pipe 4.

We claim:

1. Method for actuating specialized operating equipment in a drilled well having at least one well zone sharply slanted with respect to a vertical, said drilled well having at least one first tubular control column along which the specialized operating equipment are remotely installed, the method comprising the steps of:

introducing a control member into said first tubular control column, attaching a cable means at one end of said control member, lowering said control member into said first tubular control column by downward hydraulic pumping, bypassing specialized operating equipment which is to remain inoperative while allowing the control member to be positioned so as to enable selective specialized operating equipment to be operated, paying out the cable means from the surface into the first tubular control column, raising the control member by pulling on the cable means from the surface, and selectively maneuvering the specialized operating equipment while the control member is flush against said specialized operating equipment in a downward or upward travel of the control member in the drilled well.

2. Method for operating specialized operating equipment according to claim 1, wherein said control member includes means for allowing said control member to bypass certain specialized operating equipment while activating at least one item of the specialized equipment including at least one key sliding bolt means, provided at a circumference of said control member, said key sliding bolt means being cooperable with an operating seat of the at least one item of said specialized operating equipment, said operating seat having a shape matching a shape of said at least one key sliding bolt means, and wherein the step of introducing includes moving said control member into said first tubular control column so as to be flush against said item of specialized operating equipment, and wherein the method further includes the steps of:

interlocing said key sliding bolt means with the associated operating seat of said at least one item of specialized operating equipment, prolonging movement of said control member as the control member operates said at least one item of specialized operating equipment, disengaging said key sliding bolt means from said operating seat once the step of maneuvering has been carried out, and raising the control member to the surface.

3. Method for operating specialized equipment according to one of claims 1 or 2, wherein the specialized equipment includes valve means for producing fluid from the geological formation traversed by the well, and wherein the method further comprises the steps of:

operating said valve means by said control member, causing the fluid to flow in said first tubular control column, and producing said fluid at the surface in a a production column connected at a bottom end thereof with a bottom end of said tubular control column.

4. Device for operating specialized manipulation equipment in a drilled well having at least one well zone sharply slanted with respect to the vertical, said drilled well having a least one first tubular pipe means along which said specialized manipulating equipment is remotely installed, a control member introduced into said first tubular pipe means, cable means connected to one end of said control member, downward hydraulic pumping means for moving said control member in said tubular pipe means, means for paying the cable means into the tubular pipe means, means for pulling on the cable means from the surface, and means provided on said control member for allowing a selective control of at least some of said specialized manipulating equipment while bypassing other of said specialized manipulating equipment when the control member presses flush against said specialized manipulating equipment as the control member is raised or lowered in the drilled well.

5. Device for operating specialized manipulating equipment according to claim 4, wherein said means for allowing includes at least one key sliding bolt means for cooperating with an operating seat means of at least one item of the specialized manipulating equipment, said at least one key sliding bolt means is provided at a circumference of the control member, and said operating seat means has a shape matching a shape of said key sliding bolt means.

6. Device for operating specialized manipulating equipment according to claim 5, further comprising means for interlocking said key sliding bolt means with the operating seat means of said equipment, means for driving said specialized manipulating equipment by said control member at a time of interlocking, and means for disengaging said key sliding bolt means once an operation by the control member has been carried out.

7. Device for operating specialized manipulating equipment according to claim 6, wherein said first tubular pipe means includes a tubular control column, the specialized manipulating equipment includes valve means for producing fluid from geological formations traversed by the well, and a second pipe means including a production column connected at a bottom end thereof with a bottom end of said tubular control column.

8. Device for operating specialized manipulating equipment according to claim 7, further comprising a pump means disposed in the production column.

9. Device for operating specialized manipulating equipment according to claim 8, further comprising means for circulating fluid through the control member once a certain threshold of pull on said cable means has been exceeded, wherein the fluid circulation through said control member is effected from an upper part of the control member connected to the cable means to a lower part of the control member.

10. System for producing fluid from a geological formation traversed by a drilled well comprising a device according to claim, 9, comprising sealing means for dividing the well into several production zones separated and isolated from each other, and with at least one valve being disposed in the one production zone.

11. System for producing fluid from a geological formation, according to claim 10, wherein said sealing means include packer type seals.

12. Device for operating specialized manipulating equipment according to one of claims 4 or 5, wherein said first tubular pipe means includes a tubular control column, the specialized equipment includes valve means for producing fluid from geological formations traversed by the well, and a second pipe means including production column connected at a bottom end thereof, with a bottom end of said tubular control column.

13. Device for operating said specialized manipulating equipment according to claim 12, further comprising a pump means disposed in the production column.

14. Device according to claim 13, further comprising means for circulating fluids through the control member once a certain threshold of pull on the cable means has been exceeded, and wherein the fluid circulation through the control member is effected from an upper part of the control member connected to the cable means at a lower part of the control member.

15. System for producing fluid from a geological formulation traversed by a drilled well comprising a device according to one of claims 4, 5, 6, 7, or 8, further comprising sealing means for dividing the well into several production zones, separated and isolated from each other, and wherein a least one valve means is disposed in one production zone.

* * * * *